US008102246B2

(12) United States Patent
Davidson, II

(10) Patent No.: US 8,102,246 B2
(45) Date of Patent: Jan. 24, 2012

(54) RESETTING A TARGET DEVICE

(75) Inventor: Grover C. Davidson, II, Round Rock, TX (US)

(73) Assignee: International Business Machines Corporation, Armonk, NY (US)

( * ) Notice: Subject to any disclaimer, the term of this patent is extended or adjusted under 35 U.S.C. 154(b) by 360 days.

(21) Appl. No.: 12/348,038

(22) Filed: Jan. 2, 2009

(65) Prior Publication Data

US 2010/0171601 A1 Jul. 8, 2010

(51) Int. Cl.

| | |
|---|---|
| ***G08B 1/00*** | (2006.01) |
| ***H01H 7/00*** | (2006.01) |
| ***H01H 43/00*** | (2006.01) |
| ***H01H 3/34*** | (2006.01) |
| ***H01H 33/35*** | (2006.01) |
| ***G04F 8/00*** | (2006.01) |
| ***G04F 10/00*** | (2006.01) |

(52) U.S. Cl. ..... 340/309.16; 340/309.9; 307/141; 307/141.4; 368/108; 368/112

(58) Field of Classification Search .. 340/309.16–309.5, 340/309.8, 309.9; 307/126, 116, 141, 141.4; 219/719; 368/106, 112, 262, 263
See application file for complete search history.

(56) References Cited

U.S. PATENT DOCUMENTS 4,104,541 A * 8/1978 Jewell ..... 307/141
4,672,232 A * 6/1987 Schoen ..... 307/140
4,686,641 A 8/1987 Evans
4,912,376 A 3/1990 Strick (Continued)

FOREIGN PATENT DOCUMENTS

EP 1 887 284 A1 2/2008

OTHER PUBLICATIONS

Kim, Young-Il, et al., "SmartGlue: An Interface Controller with Auto Reconfiguration for Field Programmable Computing Machine," 2004 IEEE, pp. 734-736.

(Continued)

*Primary Examiner* — Jennifer Mehmood
(74) *Attorney, Agent, or Firm* — Frances Lammes; Stephen J. Walder, Jr.; Jill A. Poimboeuf

(57) ABSTRACT

A power reset module may reset an automatic shut-off module of a target device by momentarily disrupting power to the automatic shut-off module at a determined interval and automatically restoring power after a time period of up to two minutes. In multiple embodiments, the power reset module comprises an activation switch with an activation switch output coupled to a frequency module. The frequency module may output a frequency module signal on a determined interval via a frequency module output coupled with a reset module. The reset module momentarily transitions a reset switch to a reset state periodically at the determined interval for up to two minutes prior to automatically transitioning the reset switch to a non-reset state. Transitioning the reset switch to the reset state disrupts power to the automatic shut-off module and automatically transitioning the reset switch from the reset state to a non-reset state restores power to the automatic shut-off module thus resetting a state of the automatic shut-off module. In several embodiments, a cash register incorporates a programmable power reset device for disrupting and restoring power to an automatic shutoff circuit to reset the automatic shutoff circuit allowing a user to access the cash register.

20 Claims, 6 Drawing Sheets

U.S. PATENT DOCUMENTS

| | | | | |
|---|---|---|---|---|
| 5,272,386 | A | 12/1993 | Kephart | |
| 5,276,888 | A | 1/1994 | Kardach et al. | |
| 5,510,780 | A * | 4/1996 | Norris et al. | 340/5.42 |
| 5,650,673 | A * | 7/1997 | Maeda | 307/141.4 |
| 5,939,992 | A * | 8/1999 | Devries et al. | 340/657 |
| 6,774,768 | B2 * | 8/2004 | Flory, IV | 340/309.16 |
| 6,883,709 | B2 * | 4/2005 | Joseph | 235/381 |
| 7,248,162 | B2 * | 7/2007 | Nassimi | 340/541 |
| 2004/0178683 | A1 * | 9/2004 | Hermetz et al. | 307/141 |
| 2004/0217655 | A1 * | 11/2004 | Bruwer | 307/126 |
| 2009/0315411 | A1 * | 12/2009 | Depew | 307/141 |

OTHER PUBLICATIONS

Brakmo, Lawrence S., et al., "µSleep: A Technique for Reducing Energy Consumption in Handheld Devices," MobiSys '04, Jun. 6-9, 2004, Boston, Massachusetts, pp. 12-22.

Senger, Robert M., et al., "A 16-Bit Mixed-Signal Microsystem with Integrated CMOS-MEMS Clock Reference," DAC 2003, Jun. 2-6, 2003, pp. 520-525.

* cited by examiner

NORMALLY OPEN RELAY

NPN BIPOLAR JUNCTION POWER TRANSISTOR

FIG. 5

500

| TIMER | TIMER INTERVAL |
|---|---|
| RESET TIMER | 0-.1 seconds<br>0-.3 seconds<br>0-10 seconds<br>0-30 seconds<br>0-55 seconds<br>0<60 seconds<br>adjustable by consumer<br>preset by manufacturerer |
| FREQUENCY TIMER | 0-30 minutes<br>0-1 hours<br>0-1.5hours<br>0-2 hours<br>adjustable by consumer<br>preset by manufacturer |
| ACTIVATION TIMER | 0-6 hours<br>0-12 hours<br>0-24 hours<br>adjustable by consumer<br>preset by manufacturer |

RESETTING A TARGET DEVICE

BACKGROUND

Timers are available to control a variety of devices and functions. For example, timers may be utilized for operating outdoor lawn sprinkler systems as well as for aesthetic scenarios ranging from a string of Christmas lights to a complex animated holiday display. A variety of conditions may affect the timer activation including time settings for indoor security lights or light conditions for outdoor security lighting.

Programmable timers may control multiple devices and functions. For example, a homeowner may program lights in one room to turn on and off according to a different schedule than in another room. Software-based programmable timers provide the capacity to control exponentially more schedules of more target devices. For example, a business may utilize the software-based timer to control lawn sprinklers, lighting systems on various building levels, air conditioning systems, and outdoor security lighting as well as landscape lighting. Programming all of these systems concurrently exceeds the capacity of a standard programmable timer.

When a timer turns a device off, the device is rendered unusable until the timer powers it on again according to the timer interval. As a safety feature, a device may include an automatic shut-off module to power off the device for a designated time period. While the device is powered off, a user is unable to utilize the device and must wait for the device to be powered on.

SUMMARY

One embodiment provides a power reset device. The power reset device contemplates an activation switch having an activation switch output; a frequency module coupled with the activation switch output, the frequency module to output a frequency module signal on a determined interval via a frequency module output; and a reset module coupled with the frequency module output to momentarily transition a reset switch to a reset state periodically at the determined interval, the reset module to transition the reset switch to the reset state for up to two minutes prior to automatically transitioning the reset switch to a non-reset state.

Another embodiment provides a method for resetting a target device. The method generally comprises initiating a determined interval; transitioning a reset switch to a reset state to disrupt power to an automatic shut-off module in response to initiating the determined interval; and automatically transitioning the reset switch from the reset state to a non-reset state to restore power to the automatic shut-off module after a time period of up to two minutes to reset a state of the automatic shut-off module.

Another embodiment provides a power reset system. The power reset system comprises a a target device comprising an automatic shut-off module; and a power reset module coupled with the automatic shut-off module to momentarily disrupt power to the automatic shut-off module to reset the automatic shut-off module, the power reset module to disrupt power to the automatic shut-off module at a determined interval and restore power to the automatic shut-off module automatically after a time period of up to two minutes.

BRIEF DESCRIPTION OF THE DRAWINGS

FIG. 5 depicts an example of a table of timer interval data for a power reset device.

DETAILED DESCRIPTION

Figure 1:
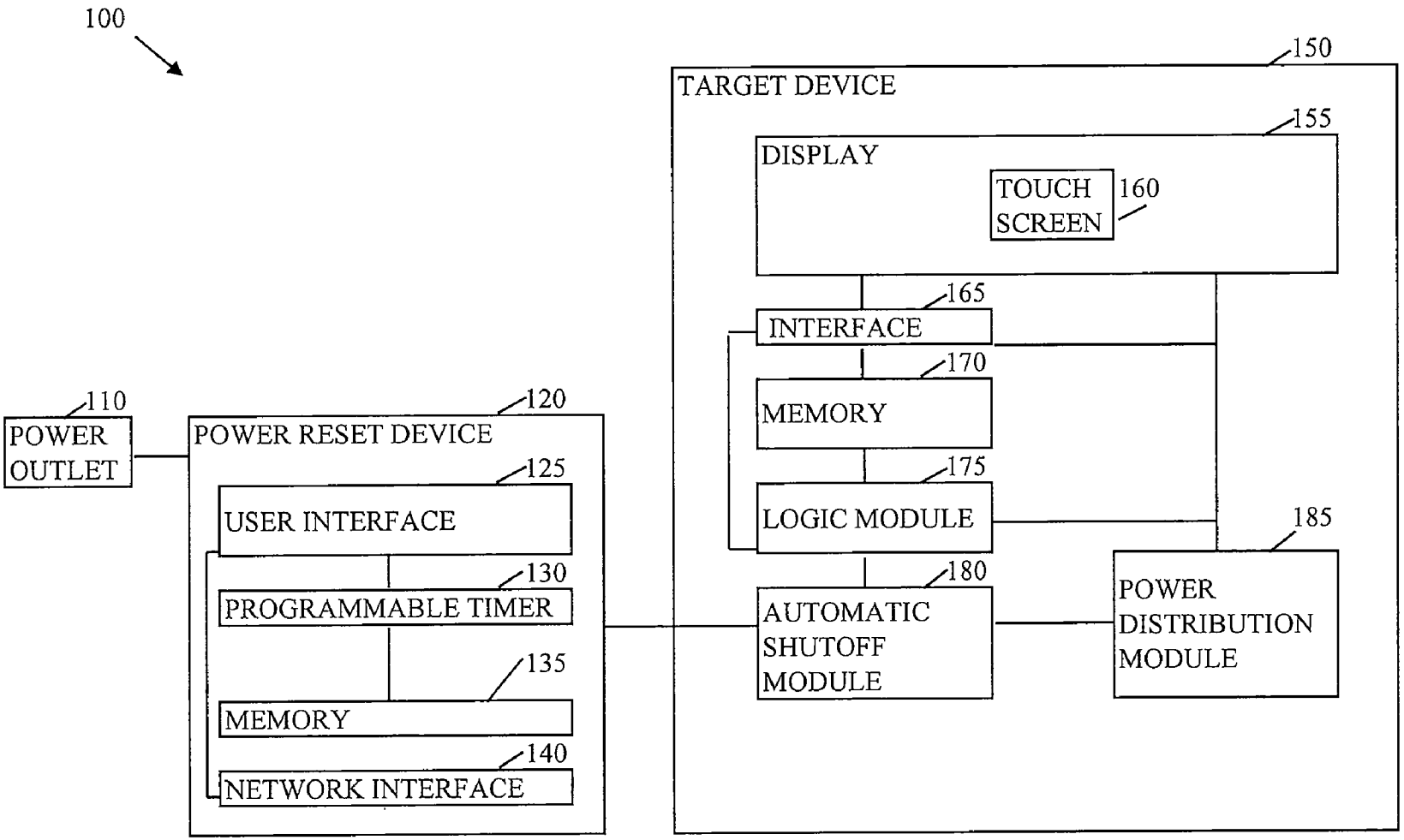
FIG. 1 illustrates a power reset system.

The following is a detailed description of novel embodiments depicted in the accompanying drawings. However, the amount of detail offered is not intended to limit anticipated variations of the described embodiments; on the contrary, the claims and detailed description are to cover all modifications, equivalents, and alternatives falling within the spirit and scope of the present teachings as defined by the appended claims.

The detailed descriptions below are designed to make such embodiments understandable to a person having ordinary skill in the art. Embodiments may comprise logic such as hardware and/or code. While some of the specific embodiments described below reference embodiments with specific configurations, those of skill in the art will realize that embodiments of the present disclosure may be implemented with other configurations with similar issues or problems.

Generally, this discussion describes resetting a target device. In other words, a target device may be reset with a power reset. The power reset may comprise momentarily disrupting and restoring power to a target device or a subcomponent thereof. In several embodiments, the power reset may comprise disconnecting and reconnecting power to the target device. In many embodiments, the power reset may comprise disconnecting and reconnecting power to a control circuit of the target device. In some embodiments, the power reset device may comprise a reset timer to activate a reset switch that momentarily disrupts power to a power distribution module of the target device and restores power to the power distribution module, or at least one subcomponent thereof, creating a power reset. Alternatively, such power reset devices may create a power reset by activating and then deactivating the target device or one or more subcomponents thereof. In still further embodiments, power resets may involve changing the state of a number of switches in a sequence designed to reset control circuitry of the target device. The reset interval between deactivation and activation (or vice versa) may be, for example, an interval of up to two minutes.

The target device may be reset once by a single power reset. In addition, a reset period may include a group of power resets for resetting the target device multiple times at set intervals during the reset period. In several embodiments, the power reset device may comprise a frequency timer to output a signal activating the reset timer at a frequency interval. Consequently, power resets may occur according to the frequency interval dictating both the frequency and quantity of power resets within a reset period.

In further embodiments, a power reset device may comprise an activation module. The activation module may couple with the frequency timer to activate the frequency timer during the reset period. The activation interval setting the length of the reset period may be a default time interval, a selected time interval, or user-programmed time interval during which the target device may be reset. In some embodiments, the reset period may include a single frequency interval and, as a result, a single power reset. In other embodiments, the reset period may include a number of power resets during a definite time period defined by, e.g., an activation timer. And, in further embodiments, the reset period may comprise an indefinite time period. For example, the reset period may continue from the time the user changes the state of a switch until the user changes the state of the same switch or another switch.

In some embodiments, a programmable cash register with an automatic shutoff circuit for security couples with a power outlet via a power reset device. The power reset device may disrupt power to the programmable cash register for an interval of approximately 3 tenths of a second or more, providing sufficient time to adequately discharge a capacitance of the automatic shutoff circuit thus resetting the automatic shutoff circuit. After the power reset, the programmable cash register may be accessible by a manager for, e.g., ten minutes, to close out the register until the automatic shutoff circuit turns off the programmable cash register.

In other embodiments, the target device may comprise a coffeemaker with an automatic shut-off module, a motor with a thermal-electric automatic shut-off module, or a motor controller with an automatic shut-off module. In further embodiments, the target device may comprise a computer or a component of a computer such as a security feature with an automatic shut-off module. As long as a momentary disruption in power can reset the automatic shut-off module, the automatic shut-off module may be based on a variety of technologies including software based, thermal-electrically based, mechanically based, magnetically based, or optically based technologies.

With reference now to FIG. 1, there is shown another embodiment of a power reset system 100. Power reset system 100 may comprise a target device 150, such as a programmable cash register or a coffeemaker, coupled with a power outlet 110 via a power reset device 120. For instance, power reset system 100 may comprise a standard alternating current (AC) plug for an AC outlet. The AC plug may plug into power reset device 120 and power reset device 120 may plug into power outlet 110, which may comprise, for instance, a wall outlet or an outlet on a power strip.

The power reset device 120 may momentarily disrupt the power to a target device 150 to reset an automatic shut-off module 180 of the target device 150. The power reset device 120 may then automatically restore power to the target device 150 to allow a user to use the target device 150 such as by closing out a cash register or resetting a security feature of an electronic device or computer. Various businesses operating overnight may employ a reset safety feature to reset a device powered off for security purposes. For example, the entrance door to a 24 hour fitness center or a dormitory may include an automatic door lock during designated evening hours. To permit a fitness member or employee to exit, a power reset may reset the automatic door lock allowing the door to open.

The power reset device 120 may include a user interface 125 for adjustable user input, a programmable timer 130 for programming multiple settings, a memory 135, and a network interface 140 for receiving input. The user interface 125 may comprise a mechanical or electrical interface to allow the user to provide settings for the power reset device 120. For example, some embodiments may comprise timers with adjustable time intervals and the user may be able to change the time interval for, e.g., the activation interval, the frequency interval, and/or the reset interval. The frequency interval may also be referred to as a determined interval which may be programmable or fixed.

The user interface 125 may couple with the programmable timer 130 to receive the time interval settings for one or more time intervals. The programmable timer 130 may comprise a mechanism or circuitry to implement the time intervals provided via the user input or preprogrammed time intervals. The programmable timer 130 may also couple with the memory 135 to store settings received from the user via the user interface 125.

The memory 135 may be nonvolatile and may store timer settings including timer intervals. For instance, the memory may comprise flash memory, electrically-erasable, programmable read only memory (EEPROM), or the like. In other embodiments, the nonvolatile memory may comprise a mechanical setting that indicates a time interval.

Furthermore, the power reset device 120 may comprise the network interface 140 to facilitate remote programming over a network such as a wireless network, local area network, wide area network, or the like. The network interface 140 may comprise a wireless network interface card, a network interface cards, a wireless Internet card, a modem, or the like.

In some embodiments, the network interface 140 may couple with the user interface 125 to facilitate communication of user settings from the user over the network to the power reset device 120. For example, the user interface 125 may comprise logic to receive settings via commands, emails, or other signals from the network interface 140. The user interface 125 may also be capable of initiating a power reset period based upon input received via the network interface 140. For example, a user may transmit an instruction to the power reset device 120 to perform a power reset.

In further embodiments, the user interface 125 may be capable of communicating information about the status of the power reset device 120, the target device 150, an automatic shutoff module 180, or other element to the user via a network. For example, the user may program the power reset device 120 to email a message to the user at a specific time with the status of the automatic shut-off module 180 or in response to an event such as activation of the automatic shut-off module 180 of the target device 150.

In some embodiments, the target device 150 may be a remote computer. For example, a remotely instigated reset may provide crucial interruption of a corrupted software routine. In other embodiments, the target device 150 may comprise a motor with a thermal-electrical automatic shut-off module. For example, remote communication may adjust programmable settings to allow a power reset to reset the automatic shut-off module and power on the motor.

In additional embodiments, the target device 150 may be a coffeemaker. The coffeemaker may include an automatic shutoff module 180 to automatically shut off the coffeemaker during non-work hours, a power distribution module 185 to distribute power within the coffeemaker, a programmable display screen 155 with a touch screen 160 for adjustable user input, an interface 165, memory 170, and a logic module 175 for performing all coffeemaker logic.

The programmable display screen 155 may display coffeemaker settings and may offer programmable user options. For example, the programmable display screen 155 may display coffee brewing options such as temperature or brewing times. Also, safety options for programming the automatic shutoff module 180 may allow users to power off the coffeemaker for a designated period to prevent overheating. Also, options for timer intervals may allow users to program power resets during power off periods.

The touch screen 160 of the programmable display screen 155 may allow users to input programmable values. For example, the user may enter utilize the touch screen to manually select a brewing temperature or to designate a time of day for automatic brewing. With regard to the automatic shutoff module 180, the user may utilize the touch screen to enter a start time and end time for a shutoff period. For programming power resets, a user may employ the touch screen to designate timer intervals affecting the quantity and frequency of power resets.

The interface 165 may allow interaction between the programmable display screen 155 as well as the memory 170, the logic module 175, and the power distribution module 185. This interaction allows the interface 165 to receive values input by users via the touch screen 160 of the programmable display screen 155 which the memory 170 may store, the logic module 175 may process, or which may power on the power distribution module 185. For example, a user may enter a brewing temperature and brew time which may be stored in the memory 170 and processed by the logic module 175.

The memory 170 may store data input by a user via the touch screen 160 of the programmable display screen 155. Examples of data the memory 170 may store include timer settings such as timer intervals for use by the programmable timer 130 of the power reset device 120.

More specifically, the coffeemaker may comprise an automatic shutoff module 180 for powering off the coffeemaker such that there is no power to the coffeemaker 150. As a safety feature, powering off the coffeemaker for a period of time may prevent the coffeemaker from posing a hazard by overheating or igniting.

In other embodiments, an automatic shutoff module 180 may power off the coffeemaker according to a programmed schedule. For example, in a workplace environment, a coffeemaker may power off at the end of the business day and power on the following morning at the start of the following business day. Further, a business may program the coffeemaker to power off on weekends and holidays as well as overnight. For example, the coffeemaker may power off approximately 12 hours from 7 pm to 7 am during the week and approximately 60 hours over a weekend beginning at 7 pm Friday and continue to 7 am Monday.

The safety feature of the automatic shutoff module 180 may prevent workers staying beyond the typical workday from making coffee during the hours the target device 150 is powered off. In order to accommodate atypical work schedules, momentarily disrupting and restoring the automatic shutoff module 180 may reset the coffeemaker permitting a worker to bypass the shutdown to brew a pot of coffee. Rather than waiting until morning, an after-hours worker may bypass the power off safety feature in order to brew coffee at any time.

The power distribution module 185 may distribute power to coffeemaker components and may be reset by the power reset device. The power distribution module 185, or a component thereof, may experience momentary power disruption and power restoration via the power reset device creating a power reset. In some embodiments, the power reset device may comprise a reset timer to activate a reset switch which may couple to the power distribution module 185, or a component thereof.

With regard to coffeemaker embodiments, rather than brewing pots of coffee with the coffeemaker burner, the target device 150 may comprise an internally heated coffee reservoir dispensing per user quantities of coffee. After a power reset, the target device 150 may both brew coffee and heat the reservoir to store coffee for dispensing upon demand.

In some embodiments, the target device 150 may couple with the power outlet 110 via the power reset device 120. The power reset device may disrupt power from the coffeemaker power source for an interval of approximately 3 tenths of a second or more, which is enough time to sufficiently discharge a capacitance of circuitry of the automatic shutoff module 180 thus resetting the automatic shutoff module 180.

After the power reset, the target device 150 may be reset, allowing use of the target device. For example, if a cash register is the target device, the power reset may allow closing out the cash register. Also, if a security feature of a computer is the target device, the power reset may reset the security feature. With respect to a coffeemaker, a user may brew a pot of coffee until the automatic shutoff module 180 turns off the target device 150. For example, a user may enter a reset interval of approximately 3 tenths of a second. The power reset device 120 may disrupt power to the target device 150 for an interval of approximately 3 tenths of a second and restore the power to complete a power reset after which the user may use the target device.

A power reset may disrupt and restore power to a target device or a subcomponent thereof. In several embodiments, the power reset may disrupt and restore power to the power distribution module 185. In other embodiments, the power reset may disrupt and restore power to the automatic shutoff module 180. In some embodiments, the logic module 175 may be reset by the power reset device 120.

In several embodiments, power may flow from the power outlet 110 through the power reset device 120 to the target device 150 through the automatic shutoff module 180 to the power distribution module 185 and logic module 175. In alternative embodiments, power may instead flow either through the power distribution module 185 to the automatic shutoff module 180 or directly to the power distribution module 185 rather than from the automatic shutoff module 180 to the power distribution module 185. Other embodiments may either situate the automatic shutoff module 180 at the entry of power to send power to the power distribution module 185 or may situate the automatic shutoff module 180 between the target device 150 and the power distribution module 185.

In addition, AC power may connect between the target device 150 and the power reset device 120 rather than the power reset device 120 connecting between the power outlet 110 and the target device 150. Regardless of the power flow utilized, the target device 150 may reset when the power reset device 120 momentarily disrupts and restores power to the power device module 185 by disconnecting and reconnecting the power outlet 110 thus completing a power reset.

Additional target device embodiments may include an assortment of features. In other embodiments, the target device 150 may include a network interface allowing a user to remotely enter user settings. In the cash register embodiment, a store manager may program the cash register when he is not onsite to allow the acting manager to reset the automatic shutoff circuit and close out the cash register in the store manager's absence. In the remote computer embodiment, a user may receive notification via a network that a reset is warranted to disrupt a corrupted software routine and may remotely initiate the necessary reset.

Figure 2A:
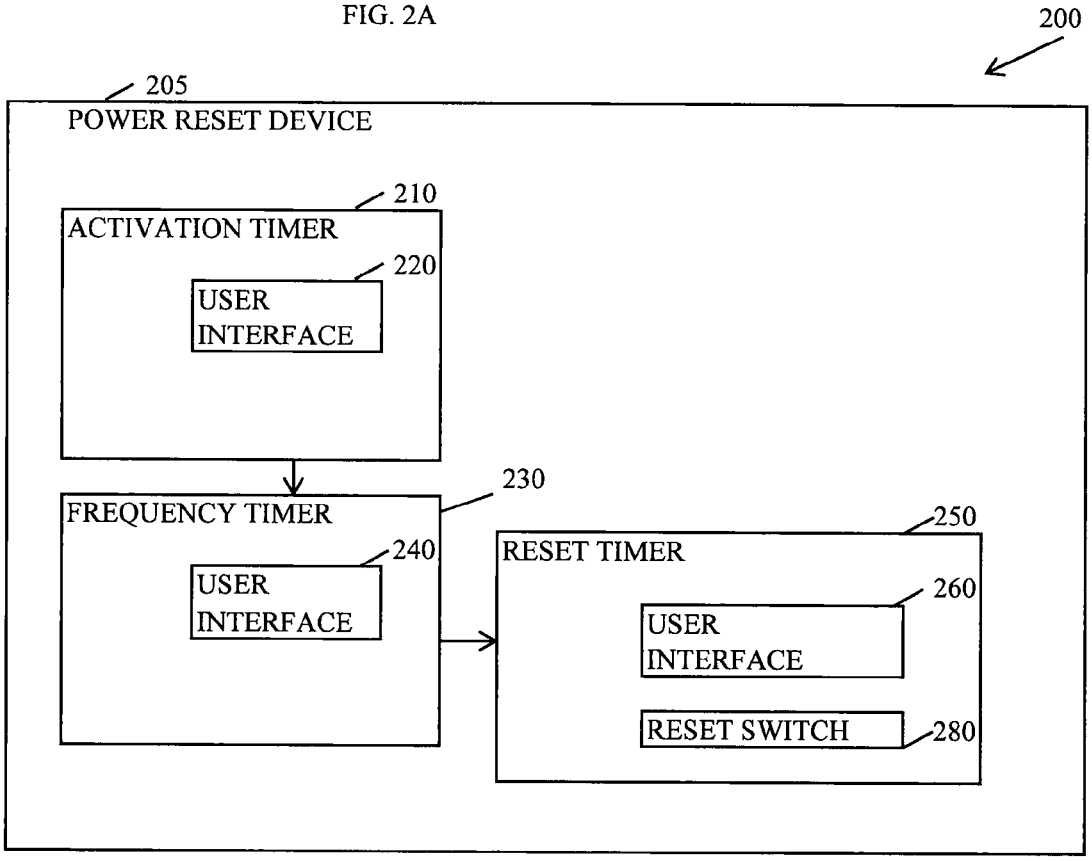
FIG. 2A illustrates an embodiment of a power reset device.

Turning now to FIG. 2 depicting embodiments of a power reset device 205 for resetting a target device with periodic power resets during a reset period. For example, the power reset device 205 may comprise an activation timer 210 with an activation timer user interface 220, connecting to a frequency timer 230 with a frequency timer user interface 240, connecting to a reset timer 250 with a reset timer user interface 260 and a reset switch 280.

The activation timer 210 of the power reset device 205 may initiate a reset period for resetting a target device. More specifically, the activation timer 210 may output a signal activating the frequency timer 230 at the activation interval. For example, a user may enter an activation interval of two hours with an activation timer user interface 220. In response, the activation timer 210 may output a signal activating the frequency timer 230 at the onset of the activation interval and output a signal that deactivates the frequency timer 230 two hours later at the end of the activation interval.

Furthermore, the activation interval of the activation timer 210 may correspond to the time span of the reset period during which the activation timer 210 activates the frequency timer 230. In response, the reset period may commence and continue until the activation interval expires. For example, the reset period for a target device may span 12 hours. To allow a worker staying late the opportunity to utilize the target device, the reset period may begin at 7 pm at the end of the business day and continue overnight until ending 12 hours later at 7 am for the start of the next business day. In contrast, a reset period may be much briefer and may span only an hour or 30 minutes or 20 minutes to accommodate use of the target device by workers attending a weekly evening meeting for example.

In a cash register embodiment, the cash register may be timer set for overnight lockdown. For example, in overnight restaurant, a manager may use key activating a switch allowing him to close out the cash register. This scenario may provide a security measure useful for attenuating or eliminating burglaries or theft by cashiers or via cashiers by automatically locking down cash registers for the evening at closing. In this example, the reset period may continue as long as the key switch was activated by the manager while the frequency interval and the reset interval would be set to match the cash register equipment. In the door lock embodiment for overnight fitness centers, the reset period may span one minute unlocking the door briefly for passage of a single person. Also, a fitness center employee may choose a longer reset period to permit a group of people to enter or exit.

The frequency timer 230 may set both the frequency and quantity of power resets in a reset period. The power reset may comprise momentarily disrupting power to a target device, or a subcomponent thereof, and automatically restoring power within a 2 minute interval. The reset period may include a single power reset or multiple power resets. For example, the cash register embodiment may entail a single power reset to provide a store manager access to close out the cash register before leaving work. On the other hand, the coffeemaker embodiment may incorporate multiple power resets during an overnight shift to allow periodic coffee brewing for overnight shift workers. The doorlock embodiment may include either a single power reset on demand or a reset period with multiple power resets scheduled at pre-assigned intervals to permit ingress and egress at predicted times.

The frequency timer 230 may initiate periodic power resets within the reset period with a frequency set by the frequency interval. To elaborate, the frequency timer 230 may output a signal activating the reset timer 250 at the frequency interval whereupon the reset timer 250 may output a signal activating the reset switch 280 to perform a power reset. Consequently, power resets may occur periodically within a reset period as dictated by the frequency interval determining both the frequency and quantity of power resets within a reset period.

A user may enter frequency timer settings with the frequency timer user interface 240. For example, a user may enter an activation interval of 12 hours via the activation timer user interface 220 and a frequency interval of 1 hour via the frequency timer user interface 240. The activation timer 210 may activate the frequency timer 230 at the beginning of the 12 hour activation interval. In response, the activation timer 210 may activate the frequency timer 230 to begin the one hour frequency interval.

The reset timer 250 may set the interval of an individual power reset. More specifically, the reset timer 250 may activate the reset switch 280 to disrupt and restore power to the target device, or subcomponent thereof, according to the reset interval to create a power reset. For example, the reset interval between disruption and restoration of power may be any range less than approximately 2 minutes. In other embodiments, the reset interval may be approximately 30 seconds. In another embodiment, the reset interval may be approximately 45 seconds. In each instance, disruption and restoration of power within the 2 minute interval may reset the target device.

In some embodiments, the reset switch 280 may connect between the target device and a power outlet. In other embodiments, the reset timer 250 may be integrated with the target device and the reset switch 280 may connect between an automatic shut-off of the target device and a power outlet. For example, an automatic shut-off module of a coffeemaker may connect with a power outlet via the reset switch 280.

In a cash register embodiment, a manufacturer may preset both the reset timer interval and the frequency timer interval utilizing nonprogrammable electrical timers for the reset timer and the frequency timer. For example, a manufacturer may preset the reset interval and the frequency interval according to product categories or models. In contrast, the manufacturer may utilize a programmable timer for the activation timer allowing the consumer to enter adjustable activation intervals. For example, a user may enter activation timer settings via the programmable activation timer user interface 220 while the reset interval and frequency interval may be preset by the manufacturer as determined by the specifications of a particular cash register model. Other embodiments may incorporate a variety of timer allocations among the power reset device timers.

Figure 2B:
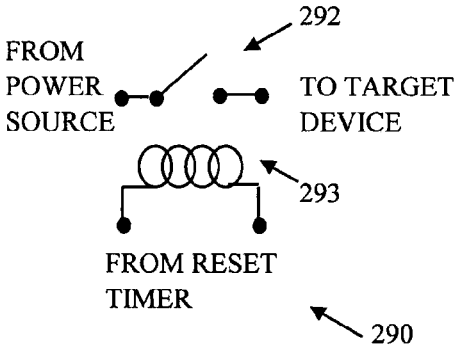
FIG. 2B illustrates an example of a normally open relay switch.

In other embodiments, the reset switch 280 may be a switch 292 of a normally open (NO) relay 290 as illustrated in FIG. 2B. The NO relay switch 292 may prevent current flow by remaining open in the inactive state. More specifically, the open inactive state equates to a de-energized coil 293 of the NO relay 290 which may disconnect the target device, or a circuit thereof, from the power source or power distribution module. On the other hand, activating the NO relay 290 may close the switch 292 by, e.g., energizing the coil 293 with the reset timer 250.

The reset timer 250 may connect the contacts between the target device, or a circuit thereof, and the power source or power distribution module, thus allowing current flow from the power source to the target device. Activation may energize the coil 293 within the NO relay 290, and the resulting electromagnetic field may close the NO reset switch 292 allowing current to flow from the power source to the target device. Activating or turning on the NO relay 290 may close the circuit thus electrically interconnecting the target device and the power source for the target device. Conversely, deactivating or turning off the NO relay 290 by terminating the current through the coil 293 may open the reset switch 292 severing the electrical interconnection between the target device and the power source for the target device.

Figure 2C:
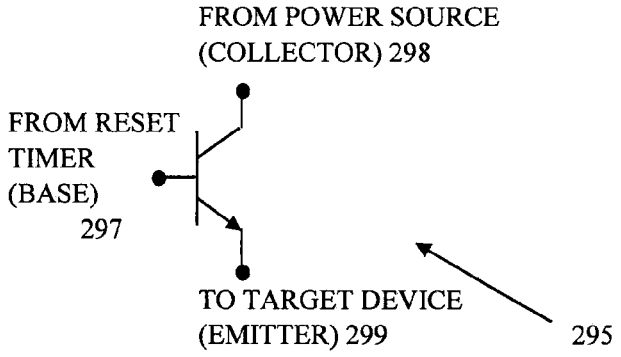
FIG. 2C illustrates an example of a bipolar junction transistor.

In alternative embodiments, the reset switch 280 may be a power transistor such as a BJT (bipolar junction transistor) 295 illustrated in FIG. 2C. The BJT controls current flow as an electronic valve and includes three sections of semiconductors which are an emitter, a base and a collector. For embodiments using an NPN BJT, the collector 298 couples with a power source, the emitter 299 couples with the target device, and the base 297 couples with the output of the reset timer 250. When the reset timer 250 outputs a voltage to initiate the power reset, the output signal activates the base of the BJT 295, allowing current to flow from the power source to the target device. After the reset interval, the output of the reset timer 250 returns to a lower voltage or ground and the base 297 of the BJT 295 no longer supplies charges to the channel of the BJT, which effectively opens the circuit between the power source and the target device and blocks further current from the collector 298 to the emitter 299.

Figure 3:
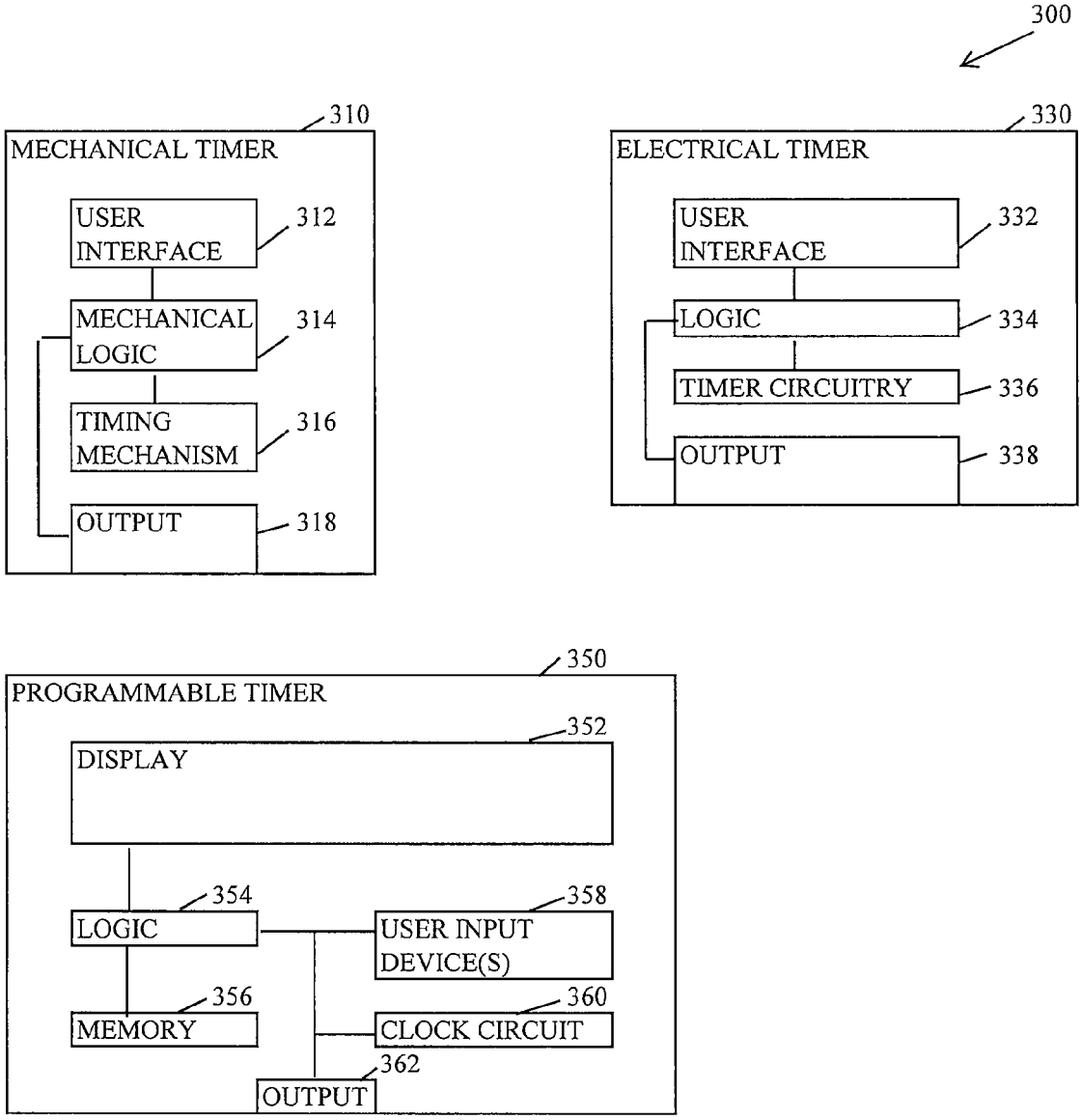
FIG. 3 illustrates examples of alternative timer embodiments including a mechanical timer, a nonprogrammable electrical timer, and a programmable timer.

Turning now to FIG. 3 depicting alternative timer embodiments. Alternative embodiments may include a mechanical timer 310, a nonprogrammable electrical timer 330, and a programmable timer 350. Each timer comprises a user interface for a user to input timer settings including timer intervals.

A mechanical timer 310 may keep time with a timing mechanism 316 and utilize stored kinetic energy (spring, suspended weight, compressed air or hydraulic fluid) rather than electricity. The timing mechanism 316 may comprise a clockwork mechanism. A user may choose timer settings with a user interface 312. The mechanical logic 314 may process the user input data to provide the mechanical timer output 318.

A nonprogrammable electrical timer 330 may keep time with timer circuitry 336 which may include the periodicity of AC input power. Also, a user may input timer settings with a user interface 332. The logic 334 may process this input data to provide the output 338 of the electrical timer 330.

A programmable timer 350 may perform the function of multiple nonprogrammable timers by offering options for multiple timer intervals, multiple schedules, and multiple functions. The programmable timer 350 may keep time with a clock circuit 360 and may display timer settings with the display 352. Users may enter adjustable timer settings with the user input device(s) 358 which may allow remote programming. For example, users may enter adjustable activation intervals to accommodate their schedules. The programmable memory 356 may be nonvolatile and may store the user input data. Further, the programmable logic 354 may process timer data and provide the output 362 of the programmable timer.

For example, in the cash register embodiment, a manufacturer may designate both the reset timer and frequency timer as nonprogrammable electrical timers. In this case, the manufacturer may preset both the reset timer interval and the frequency timer interval rather than the consumer. In contrast, the manufacturer may choose a programmable activation timer.

Figure 4:
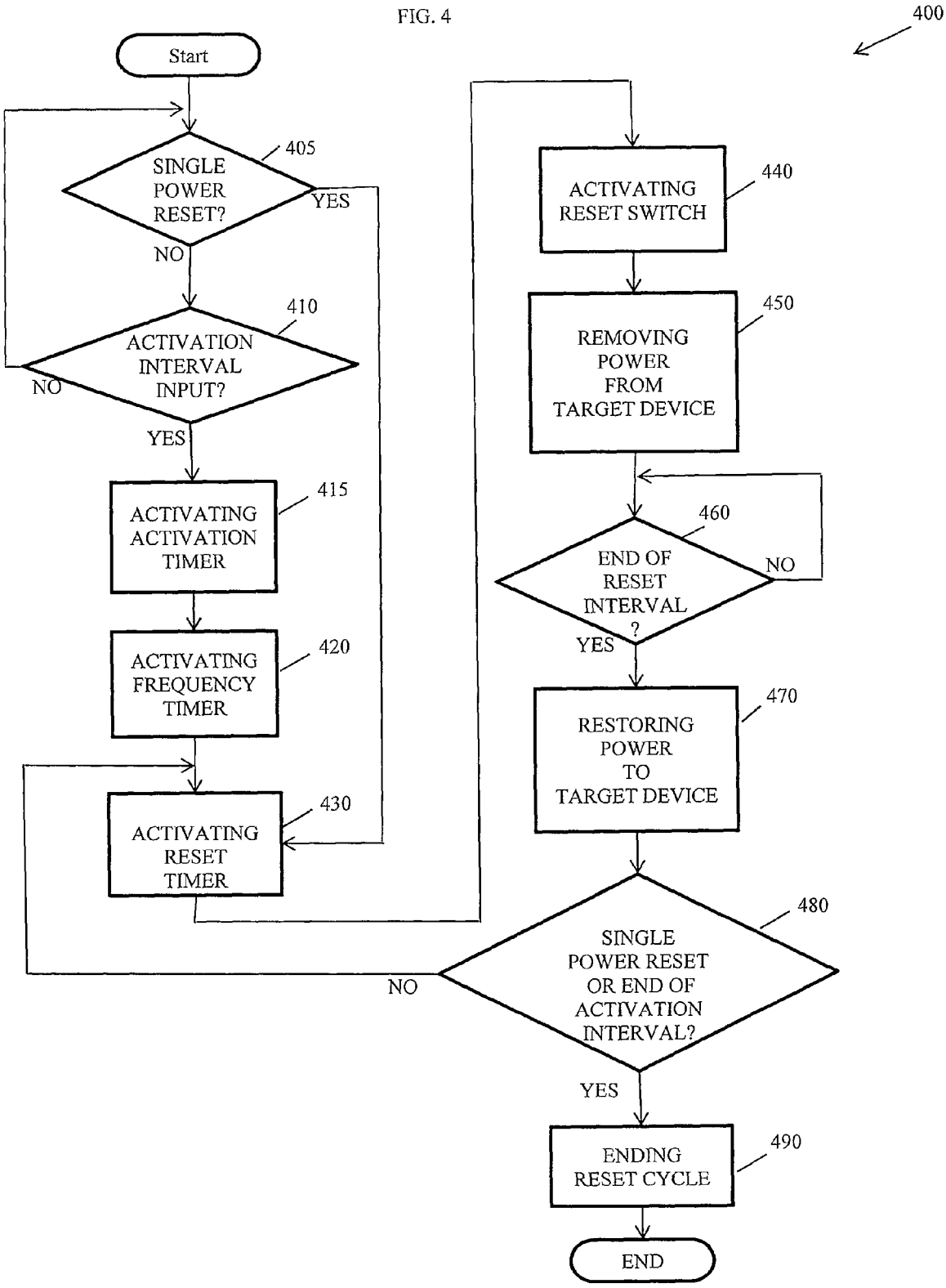
FIG. 4 depicts an example of a flow chart for resetting a target device with a power reset.

Referring now to FIG. 4, depicting an example of a flow chart 400 illustrating a reset period for a power reset device 205 shown in FIG. 2. Flow chart 400 may begin by determining whether a single power reset (element 405) is designated for the reset period as opposed to multiple periodic power resets throughout an extended reset period. With a single power reset, the reset period may commence with activating the reset timer (element 430) without utilizing either an activation timer or a frequency timer.

Alternatively, the reset period may commence upon activation interval input (element 410). More specifically, activation interval input may result in activating the activation timer (element 415). For example, a user may enter an activation interval via a user interface or a manufacturer may preset the activation interval.

Activating the activation timer (element 415) may initiate the reset period and activating the frequency timer (element 420) may produce periodic power resets within that reset period. At the onset of the reset period, activating an activation timer (element 415) with the activation interval input may result in activating a frequency timer (element 420). Continuing, activation of the frequency timer (element 420) having a frequency interval by the activation timer may provide for the periodic resets of the reset period. More specifically, activating the reset timer (element 435) by the frequency timer according to the frequency interval may set power resets at frequency intervals throughout the duration of the reset period.

Upon beginning the reset period by activating an activation timer (element 420) the reset period continues with activating the frequency timer (element 420) by the activation timer, and activating the reset timer (element 430) by the frequency timer. In contrast, initiating the reset period with a single power reset (element 405) proceeds directly to activating the reset timer (element 430). Both scenarios continue with activating the reset switch (element 440) by the reset timer.

The power reset commences upon activating the reset switch (element 440) by the reset timer. The reset switch conducts a power reset by momentarily disrupting power to the target device (element 450) or a subcomponent thereof and restoring power (element 470) within a 2 minute reset interval.

In addition, activating the reset switch (element 440) by the reset timer may result in disrupting power to the target device (element 450) and restoring power to the target device (element 470), or a sub component thereof, creating a power reset. In other embodiments, the reset interval may be any interval less than 2 minutes such that the power reset is a momentary disruption and restoration of power. More specifically, the reset switch may disrupt power to the target device to begin a power reset. Upon expiration of the reset period, the reset switch may restore power to the target device to complete the power reset.

Whether it is the end of the reset interval (element 460) may determine whether to complete the power reset by restoring power to the target device (element 470) which may not occur before the end of the specified reset interval. Otherwise, the time remaining in the reset interval may expire before restoring power to the target device (element 470). For example, if the reset interval is 30 seconds, only upon 30 seconds expiring may the reset switch respond by restoring power to the target device (element 470).

In an alternative embodiment, a control circuit may exhibit a default powered off state which disqualifies the circuit for a power reset. To become eligible for a power reset, the control circuit may require powering on from the default powered off state. Consequently, the power reset may incorporate applying power to power on the control circuit such that the powered on control circuit may be reset by disrupting power (element 450) and restoring power (element 470).

Whether it is the end of the activation interval (element 480) may determine whether it is the end of the reset period (element 490) because expiration of the reset period terminates the reset period. If the activation interval has not expired, the reset period may continue resulting in additional power resets spaced apart the length of the frequency interval until the activation interval expires and the reset period terminates. In some embodiments, the reset period may comprise a single reset such that the reset period terminates concurrently with the activation interval (element 480)

The activation interval of the activation timer may correspond to the time span of the reset period while the frequency interval of the frequency timer may set the frequency and quantity of power resets during a given reset period. Consequently, output from the activation timer may activate the frequency timer at the onset of the activation interval. Continuing, output from the frequency timer may activate the reset timer at frequency intervals within the reset period until the reset period expires.

In some embodiments, the activation interval may be approximately 12 hours while the frequency interval may be approximately 1 hour. Output from the activation timer may activate the frequency timer at the beginning of the 12 hour activation interval, and output from the frequency timer may activate the reset timer hourly within the 12 hour activation interval. Because activating the reset timer (element 430) hourly leads to activating the reset switch (element 440) hourly, the reset switch may reset the power source of the target device hourly during the 12 hour activation interval. For example, a cash register may have a 12 hour overnight reset period starting at the end of a business day and concluding at the beginning of the next business day the following morning. Within this 12 hour activation interval, the cash register may reset hourly according to the 1 hour frequency interval until the 12 hour activation interval expires at which time the reset period terminates.

Turning now to FIG. 5 which is an example of a table of timer interval data 500 for a power reset device 300 as shown in FIG. 3. In particular, the left column of the table lists the power reset device timers which may include the activation timer having an activation interval, the frequency timer having a frequency interval, and the reset timer having a reset interval. The right column presents examples of approximate numerical interval data for the respective timer.

To summarize the various timer intervals, the activation interval of the activation timer may set the time span of the reset period. Within this reset period, the frequency interval of the frequency timer may set the frequency and quantity of power resets during a given reset period. During a power reset, the reset interval of the reset timer may set the time delay between deactivation and activation of the power source of the target device which may be any range less than 2 minutes. In other embodiments, the reset interval may be approximately 0 seconds to 30 seconds. In additional embodiments, the reset interval may be approximately 45 seconds.

A user may enter timer intervals as well as other settings via user interfaces. For example, user interfaces may allow for manual entry or remote wireless entry. Also, a manufacturer may preset all timer intervals or may choose various permutations of presetting some intervals and allowing consumers to enter other intervals with a user interface if they choose to alter the default interval provided by the manufacturer.

For example, a manufacturer may preset timer intervals based on differing power requirements among various models or product categories while allowing other intervals to remain adjustable by the consumer. In other embodiments, a manufacturer may preset both the reset interval and the frequency interval to be constant for a particular model while allowing consumers to enter adjustable activation intervals. In this case, the manufacturer may utilize nonprogrammable electrical timers for both the reset timer and the frequency timer with preset intervals. In contrast, the activation timer may be a programmable timer with adjustable activation intervals input by consumers via a user interface.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Another embodiment may have implementation as a program product for implementing systems and methods described with reference to FIGS. 1-5. Embodiments may take the form of an entirely hardware embodiment, an entirely software embodiment, or other embodiments containing both hardware and software elements. One embodiment may have implementation in software, which includes but is not limited to firmware, resident software, microcode, etc.

Furthermore, embodiments may take the form of a computer program product accessible from a computer-usable or computer-readable medium providing program code for use by or in connection with a computer or any instruction execution system. For purposes of this description, a computer-usable or computer-readable medium may be any apparatus that may contain, store, communicate, propagate, or transport the program for use by or in connection with the instruction execution system, apparatus, or device.

The medium may be an electronic, magnetic, optical, electromagnetic, infrared, or semiconductor system (or apparatus or device) or a propagation medium. Examples of a computer-readable medium may include a semiconductor or solid state memory, magnetic tape, a removable computer diskette, a random access memory (RAM), a read-only memory (ROM), a rigid magnetic disk, and an optical disk. Examples of optical disks may include compact disk-read only memory (CD-ROM), compact disk-read/write (CD-R/W), and DVD.

A data processing system suitable for storing and/or executing program code may include at least one processor coupled directly or indirectly to memory elements through a system bus. The memory elements may include local memory employed during actual execution of the program code, bulk storage, and cache memories which provide temporary storage of at least some program code in order to reduce the number of times code must be retrieved from bulk storage during execution.

Input/output or I/O devices (including but not limited to keyboards, displays, pointing devices, etc.) may couple to the system either directly or through intervening I/O controllers. Network adapters may also couple to the system to enable the data processing system to couple to other data processing systems or remote printers or storage devices through intervening private or public networks. Modems, cable modem, and Ethernet adapter cards are just a few of the currently available types of network adapters.

The logic as described above may be part of the design for an integrated circuit chip. A graphical computer programming language may create the chip design. A computer storage medium (such as a disk, tape, physical hard drive, or virtual hard drive such as in a storage access network) may store the chip design. If the designer does not fabricate chips or the photolithographic masks used to fabricate chips, the designer may transmit the resulting design by physical means (e.g., by providing a copy of the storage medium storing the design) or electronically (e.g., through the Internet) to such entities, directly or indirectly. The stored design may be converted into the appropriate format (e.g., GDSII) for the fabrication of photolithographic masks, which typically include multiple copies of the chip design in question that are to be formed on a wafer. The photolithographic masks may be utilized to define areas of the wafer (and/or the layers thereon) to be etched or otherwise processed.

The resulting integrated circuit chips may be distributed by the fabricator in raw wafer form (that is, as a single wafer that has multiple unpackaged chips), as a bare die, or in a packaged form. In the latter case, the chip may be mounted in a single chip package (such as a plastic carrier, with leads that are affixed to a motherboard or other higher level carrier) or in a multichip package (such as a ceramic carrier that has either or both surface interconnections or buried interconnections). In any case, the chip may integrate with other chips, discrete circuit elements, and/or other signal processing devices as part of either (a) an intermediate product, such as a motherboard, or (b) an end product. The end product may be any product that includes integrated circuit chips, ranging from toys and other low-end applications to advanced computer products having a display, a keyboard or other input device, and a central processor.

The form of the embodiments shown and described in the detailed description and the drawings are to be taken merely as examples. It is intended that the following claims be interpreted broadly to embrace all variations of the example embodiments disclosed. Although the present disclosure and some of its advantages have been described in detail for some embodiments, it should be understood that various changes, substitutions, and alterations may be made herein without departing from the spirit and scope of the disclosure as defined by the appended claims. Although specific embodiments may achieve multiple objectives, not every embodiment falling within the scope of the attached claims will achieve every objective. Moreover, the scope of the present application is not intended to be limited to the particular embodiments of the process, device, manufacture, composition of matter, means, methods, and steps described in the specification.

As one of ordinary skill in the art will readily appreciate from this disclosure, processes, devices, manufacture, compositions of matter, means, methods, or steps presently existing or later to be developed that perform substantially the same function or achieve substantially the same result as the corresponding embodiments described herein may be utilized. Accordingly, the appended claims are intended to include within their scope such processes, devices, manufacture, compositions of matter, means, methods, or steps.

What is claimed is:

1. An apparatus comprising:

an activation switch having an activation switch output;

a frequency module coupled with the activation switch output, the frequency module to output a frequency module signal on a determined interval via a frequency module output; and a reset module coupled with the frequency module output to momentarily transition a reset switch to a reset state to disrupt power to an automatic shut-off module that is currently preventing a target device from performing normal operations in response to receiving the frequency module signal at the determined interval thereby allowing the target device to perform normal operations, the reset module to automatically transition the reset switch from the reset state to a non-reset state to restore power to the automatic shut-off module after a predetermined time to reset a state of the automatic shut-off module thereby allowing the automatic shut-off module to prevent the target device from performing normal operations.

2. The apparatus of claim 1, further comprising an activation timer coupled with the activation switch output, the activation timer having an activation timer output wherein the frequency module comprises a frequency module input coupled with the activation timer output, the activation timer output to activate the frequency module.

3. The apparatus of claim 1, further comprising a user interface for a user to enter the determined interval at which the frequency module outputs the frequency module signal.

4. The apparatus of claim 1, wherein the reset switch is a normally open relay switch.

5. The apparatus of claim 1, wherein the reset switch is a bipolar junction transistor.

6. The apparatus of claim 1, further comprising a programmable timer with a nonvolatile memory, computer software to program the programmable timer, a software user interface for a remote user to enter the determined interval for the frequency module from a wireless device.

7. A method comprising:

initiating a determined interval;

transitioning a reset switch to a reset state to disrupt power to an automatic shut-off module that is currently preventing a target device from performing normal operations in response to initiating the determined interval thereby allowing the target device to perform normal operations; and automatically transitioning the reset switch from the reset state to a non-reset state to restore power to the automatic shut-off module after a predetermined time period to reset a state of the automatic shut-off module thereby allowing the automatic shut-off module to prevent the target device from performing normal operations.

8. The method of claim 7, wherein the determined interval is 0 to 30 seconds.

9. The method of claim 7, wherein the determined interval is one hour.

10. The method of claim 7, wherein the determined interval is 12 hours.

11. A computer program product for resetting an automatic shut-off module, the computer program product comprising:

a computer usable medium having computer usable program code embodied therewith, the computer usable program code comprising:

computer usable program code configured to perform operations, the operations comprising:

initiating a determined interval;

transitioning a reset switch to a reset state to disrupt power to an automatic shut-off module that is currently preventing a target device from performing normal operations in response to initiating the determined interval thereby allowing the target device to perform normal operations; and automatically transitioning the reset switch from the reset state to a non-reset state to restore power to the automatic shut-off module after a predetermined time period to reset a state of the automatic shut-off module thereby allowing the automatic shut-off module to prevent the target device from performing normal operations.

12. A system comprising:

a target device comprising an automatic shut-off module; and a power reset module coupled with the automatic shut-off module to momentarily transition a reset switch to a rest state to disrupt power to the automatic shut-off module that is currently preventing the target device from performing normal operations in response to receiving a signal at a determined interval thereby allowing the target device to perform normal operations, the power reset module to automatically transition the reset switch from the reset state to a non-reset state to restore power to the automatic shut-off module after a predetermined time period to reset a state of the automatic shut-off module thereby allowing the automatic shut-off module to prevent the target device from performing normal operations.

13. The system of claim 12, further comprising a cash register.

14. The system of claim 13, further comprising an automatic shutoff circuit to power off the cash register.

15. The system of claim 14 wherein disrupting and restoring power to the automatic shutoff circuit resets the automatic shutoff circuit allowing a user to access the cash register.

16. The system of claim 12, further comprising a programmable timer.

17. The system of claim 16, wherein the programmable timer comprises a non-volatile memory.

18. The system of claim 17, further comprising a programmable display screen interface for a user to input the determined interval.

19. The system of claim 18, wherein the programmable display screen interface comprises a memory for storing the determined interval.

20. The system of claim 19 further comprising, computer software to program the programmable timer, a software user interface for a remote user to enter the determined interval from a wireless device.

* * * * *